US005228829A

United States Patent [19]

Niskanen et al.

[11] Patent Number: 5,228,829

[45] Date of Patent: Jul. 20, 1993

[54] METHOD AND APPARATUS FOR DIVIDING FLOW OF HIGH-CONSISTENCY FIBER SUSPENSION

[75] Inventors: Toivo Niskanen, Hamina; Voitto Reponen, Karhula; Jukka Timperi; Reijo Vesala, both of Kotka; Vesa Vikman, Kymi, all of Finland

[73] Assignee: A. Ahlstrom Corporation, Noormarkku, Finland

[21] Appl. No.: 551,398

[22] Filed: Jul. 12, 1990

Related U.S. Application Data

[63] Continuation-in-part of Ser. No. 898,204, Aug. 20, 1986, Pat. No. 4,964,950.

[51] Int. Cl.[5] ..... F01D 1/00

[52] U.S. Cl. ..... 415/182.1; 415/225

[58] Field of Search ..... 415/225, 182.1, 93, 415/203, 206, 169.1, 168.1, 199.6, 143

[56] References Cited

U.S. PATENT DOCUMENTS

| | | | |
|---|---|---|---|
| 2,504,140 | 4/1950 | Mill . | |
| 2,627,812 | 2/1953 | Mann | 415/169.1 X |
| 2,780,490 | 2/1957 | Sigvardt | 415/182.1 X |
| 3,136,254 | 6/1964 | Douglas | 415/206 |
| 3,446,151 | 5/1969 | Andersson . | |
| 3,540,834 | 11/1970 | Allerton | 415/225 X |
| 3,698,830 | 10/1972 | Goyne | 415/168.1 X |
| 3,851,993 | 12/1974 | Foster | 415/203 X |
| 3,928,187 | 12/1975 | Young | 415/225 X |
| 4,596,511 | 6/1986 | Weinrib | 415/225 X |
| 4,776,758 | 10/1988 | Gullichsen | 415/169.1 |
| 4,815,929 | 3/1989 | Weinrib | 415/225 X |
| 4,981,413 | 1/1991 | Elonen et al. | 415/169.1 X |

FOREIGN PATENT DOCUMENTS

| | | | |
|---|---|---|---|
| 1961272 | 6/1971 | Fed. Rep. of Germany | 415/93 |
| 465668 | 9/1951 | Italy | 415/203 |
| 491608 | 3/1954 | Italy | 415/182.1 |
| 229225 | 10/1967 | U.S.S.R. | 415/93 |
| 1525326 | 11/1989 | U.S.S.R. | 415/182.1 |
| 499357 | 1/1939 | United Kingdom | 415/182.1 |
| 1493205 | 11/1977 | United Kingdom | 415/182.1 |
| 8802444 | 4/1988 | World Int. Prop. O. | 415/182.1 |

*Primary Examiner*—Thomas E. Denion
*Assistant Examiner*—Todd Mattingly
*Attorney, Agent, or Firm*—Cohen, Pontani, Lieberman, Pavane

[57] ABSTRACT

A method and an apparatus for dividing the flow of fiber suspensions of the pulp and paper industry in which the fiber suspension is caused to flow into a space uniting the inlet and the outlet flows and in which space a vortex flow is created to prevent the suspension from forming a strong fiber network and from causing blockage of the system. The pressure of the suspension further is increased so that the suspension flowing into the apparatus need not be pressurized. The apparatus includes a vortex chamber provided with one inlet and several outlets, at least one of the outlets is preferably provided with a device for regulating the flow through the outlet. The apparatus further includes a rotor for moving the suspension through the several outlets towards further processing devices.

5 Claims, 5 Drawing Sheets

METHOD AND APPARATUS FOR DIVIDING FLOW OF HIGH-CONSISTENCY FIBER SUSPENSION

This is a continuation-in-part of pending Ser. No. 898,204, filed Aug. 20, 1986 now U.S. Pat. No. 4,964,950.

FIELD AND BACKGROUND OF THE INVENTION

The present invention relates to a method and an apparatus for dividing the flow of a fiber suspension in the pulp and paper industry into partial streams.

The pulp and paper industry often requires that a fiber suspension is conveyed from a vessel or a pipe continuously or intermittently, divided evenly or unevenly, to several places, e.g. from a storage tank simultaneously to two or more processing devices. When the consistency of the suspension is low, i.e. up to about 5 percent, dividing of the flow itself does not cause any problems, but when the consistency is higher than about 5% there is only a small amount of free liquid between the fibers and the fibers form a strong fiber network. The strength of the network depends on the consistency. The characteristics of medium or high consistency fiber suspensions are quite different from that of a true liquid and the handling thereof becomes more difficult the higher the consistency is.

As stated, when the consistency is high, e.g. from about 8 to about 25 percent, the fiber suspension forms a strong fiber network and dividing the fiber suspension in a pipeline or other conduit is mostly impossible without special measures. When a high-consistency fiber suspension arrives, usually in form of a plug flow, at a junction point in the pipeline, the fiber network is too strong to be dispersed. The rigid fiber network will also adhere to a part of the pipe resulting in clogging of the pipeline. When one branch of the pipeline is not in use i.e. it is closed by a valve, the portion of the pipe preceding the valve is readily clogged and will not open up when the valve is opened as the friction is the highest while the suspension is at rest and the line pressure is insufficient to push the fiber plug forward.

The above-described problem in dividing the pulp flow is avoided by subjecting the flow to a field of shear forces of sufficient strength so that the bonds between the fibers are loosened or broken and instead an at least partially turbulent flow is created in which there exist no fiber networks that prevent the division of the suspension. In low consistency fiber suspension (below about 5%) the shear forces may be created by the geometry of the junction point, while in high consistency fiber suspension, (above about 5%) sufficient shear forces are generated by a rotor arranged at or in the vicinity of to the junction point.

In many practical applications the above described dividing apparatus, with or without a rotor, has been placed in a conduit closely after or downstream of the pump. The pressure drop in the dividing apparatus, especially in the one having no rotor, is so high, particularly when the consistency of the pulp suspension is high, that the pressure created by the pump is almost totally lost in the dividing apparatus.

Up to now, there have been known devices designed solely for dividing the flow of fiber suspension. In other words the known devices must be located in a pipeline downstream of a pump that is creating the pressure difference required for causing the pulp to flow through the dividing apparatus. However, in this known apparatus pressure loss occurs in the pipeline. The known apparatus is complex and wastes the more energy the higher the consistency of the pulp is. At this stage it is worth noticing that in many cases the pulp transfer distances are quite short in a pulp mill so that only a slight increase in pulp pressure is needed to ensure a continuous pulp flow, pipe junctions or dividing apparatus excluded. It thus appeared advantageous to create said pressure difference in the dividing apparatus between the inlet and outlet connections of the junction point for facilitating the dividing of the flow towards several outlets and for ensuring the flow of the pulp to the next treatment apparatus.

SUMMARY OF THE INVENTION

One object of the present invention is to provide a method and an apparatus by which the flow of a fiber suspension having a consistency of from about 5 to about 25 percent may be divided and the suspension be transferred in a controlled and reliable manner. More specifically, the object of the present invention is to provide a method and an apparatus by which the flow of a fiber suspension may be divided into several partial streams in a dividing apparatus and simultaneously moved by said apparatus via several flow channels to different places or locations in the pulp treating system. The applications for such apparatus are numerous. The apparatus may be used, for instance, to transfer fiber suspensions simultaneously to a number of storage tanks, to a number of feed pipes or to recirculate a portion of the pulp.

The invention is particularly useful in applications where there is a need to have a by-pass flow of a desired volume or of a desired pressure from a device to some other place in the process or, for instance, back to the suction piping of the apparatus or to the suction vessel of the device.

A main characteristic feature of the present invention is that the fiber suspension is caused to flow into a space uniting the inlet and the outlet flows and in which space a vortex flow is created to prevent the suspension from forming a rigid fiber network and from causing the blockage of the system.

The apparatus for carrying out the invention is characterized by a vortex chamber provided with one inlet, means for connecting the inlet to a source of the fiber suspension, and several outlets, at least some of the outlets being preferably provided with means for regulating the partial stream through said outlet.

BRIEF DESCRIPTION OF THE DRAWINGS

The invention is described in detail below with reference to the accompanying drawings which illustrate preferred embodiments of the apparatus for carrying out the method of the invention, in which.

DESCRIPTION OF THE PRESENTLY PREFERRED EMBODIMENTS

Figure 1:
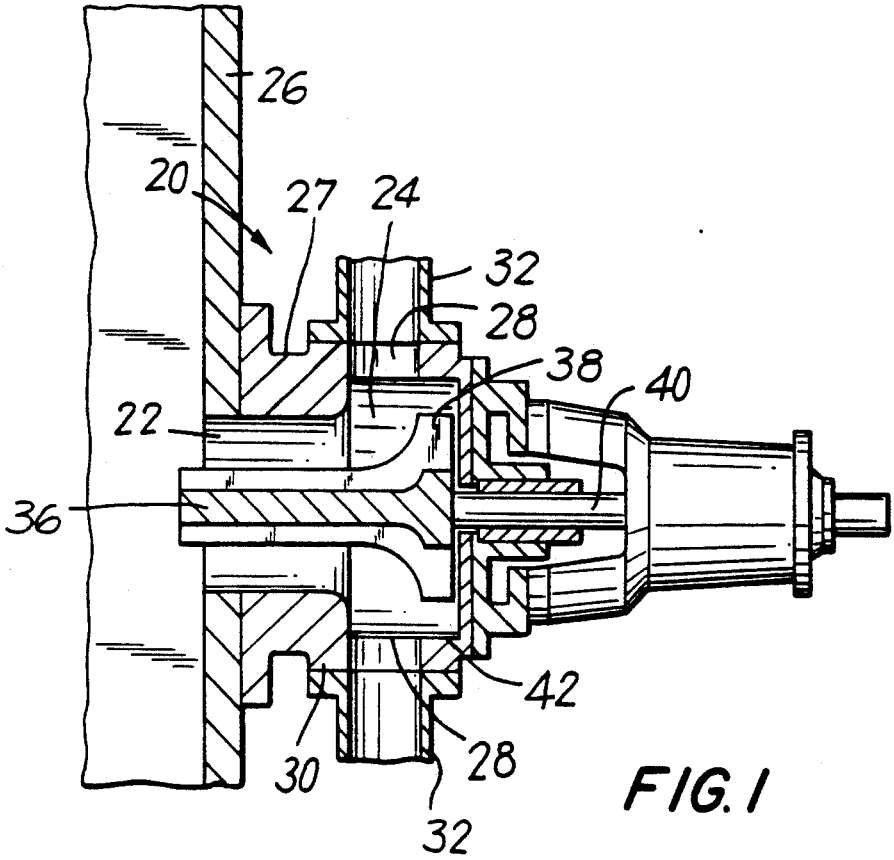
FIG. 1 is a longitudinal cross sectional view of a preferred embodiment of the apparatus in accordance with the present invention.
Figure 3:
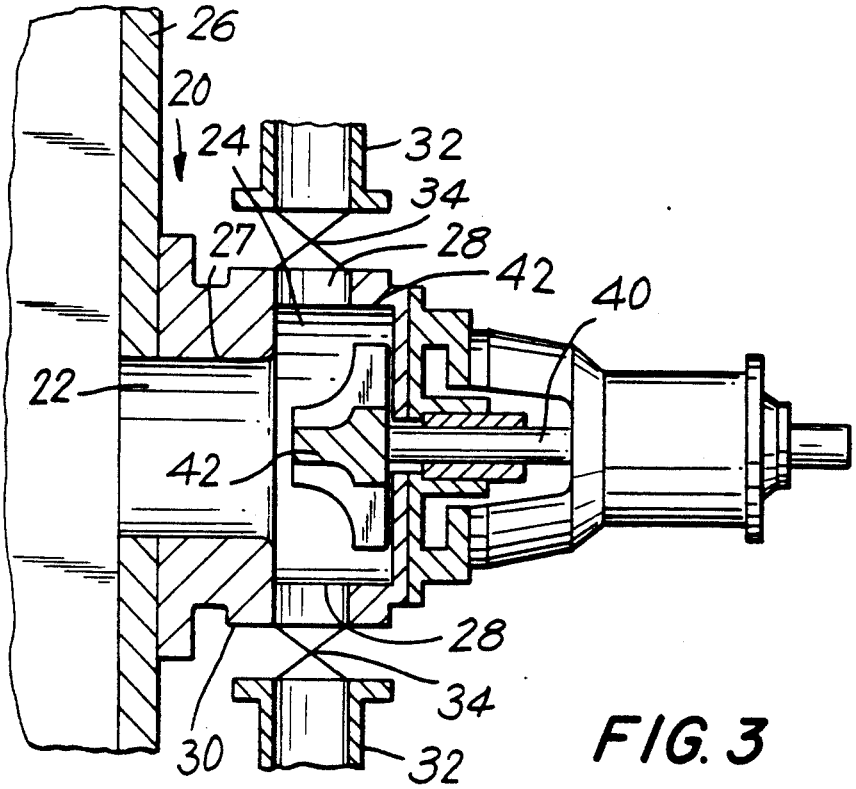
FIG. 3 is a cross-sectional view of yet another embodiment of the apparatus in accordance with the present invention.

FIGS. 1 and 3 illustrate an apparatus 20 in accordance with the present invention comprising a substantially cylindrical vortex chamber 24 with the upstream part thereof being connected to an inlet channel 22 having preferably a smaller diameter than the vortex chamber 24. The inlet channel is provided with means for mounting the apparatus 20 to a source of the fiber suspension such as pipe 26 which may be a drop leg or a pulp vessel. The diameter of the pipe 26, drop leg or pulp vessel may differ greatly from the diameter of the inlet channel 22. The inside surface 27 of the inlet channel 22 is preferably smooth, but it may also comprise axial or axially inclined ridges, protrusions or the like (not shown). The inside surface 42 of the vortex chamber 24 is provided with several outlet openings 28 having an outlet channel 30 connected thereto. In the embodiment of FIG. 1 branch pipes 32 are secured directly to the respective outlet channels 30 but the outlet channels may also be connected to the branch pipes via flow regulating means such as valves known in the art. Flow regulating means are schematically illustrated in the embodiment of FIG. 3, wherein valves 34 are arranged between the outlet channel 30 and the branch pipes 32.

FIG. 1 illustrates a rotor 36 provided with vanes 38. Rotor 36 is disposed substantially centrally in the vortex chamber 24 and extends at least partly into the inlet channel 22 and preferably through the inlet channel 22 to some extend inside the pipe 26. The higher the consistency of the pulp in the pipe, the further should the rotor be extended toward and into the pulp vessel unless a separate rotor in the pipe is used. While the consistency is low, i.e. less than about 5–7% the rotor need not necessarily extend into the inlet pipe 26 at all, see FIG. 3. The vanes 38 in the illustrated embodiment extend radially from the shaft 40 toward the outlet openings 28 so that their rotational diameter is larger than their rotational diameter in the inlet channel 22. The number of the vanes in the embodiment in accordance with FIG. 1 is four, but it may differ from that by a large amount (e.g. 3 to 12 vanes). The appearance of the rotor and its vanes may also greatly differ from the one described above and illustrated in FIG. 1. The vanes inside the upper part of the vortex chamber need not be attached to the shaft but they may be formed of separate rods or bars which are either rectangular, round or rounded, extending substantially co-axially with the inlet pipe. They may also be arranged axially or inclined i.e. spirally arranged. It is also possible that the rotor is not formed of bar-like members, but for instance made of a substantially cylindrical body having one or more protrusions, ridges or grooves on its surface. The shaft 40 of the rotor is mounted on bearings and sealed by conventionally known methods.

Yet another embodiment of the rotor is illustrated in FIG. 3, in which the rotor 42 is essentially like rotor 36 of FIG. 1. The only difference is in the length of the rotor, as the rotor in accordance with FIG. 3 is located entirely inside the vortex chamber 24. The rotor 42 does not extend into the inlet channel 22. This embodiment is especially preferred when the consistency of the fiber suspension is low.

Figure 2:
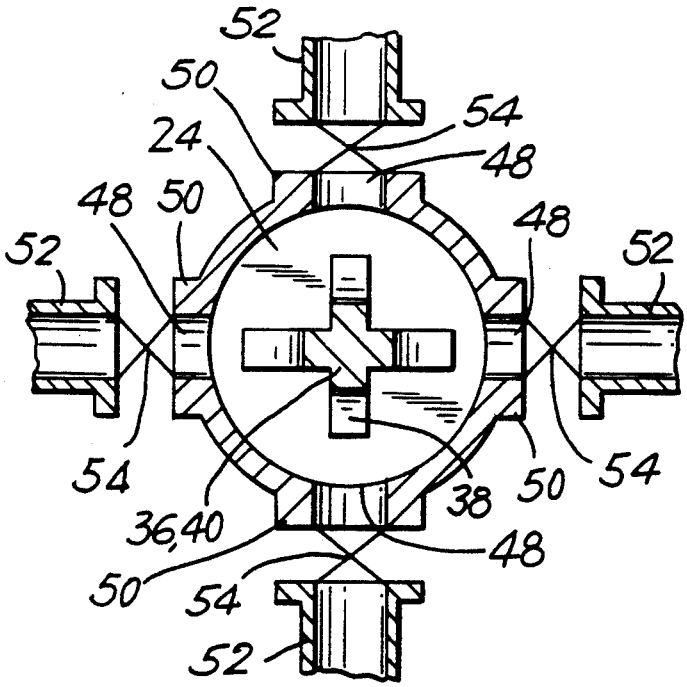
FIG. 2 is a longitudinal cross sectional view of another preferred embodiment of the apparatus in accordance with the present invention.

In FIG. 2 there is illustrated an embodiment having four outlet openings 48 disposed at an equal distance from each other and with respective outlet channels 50. Outlet channels 50 are arranged radially with respect to the vortex chamber and they are connected to branch pipes 52 by means of flow regulating means 54, but said regulating means may be omitted if no regulation of the pulp flow is desired.

Figure 4:
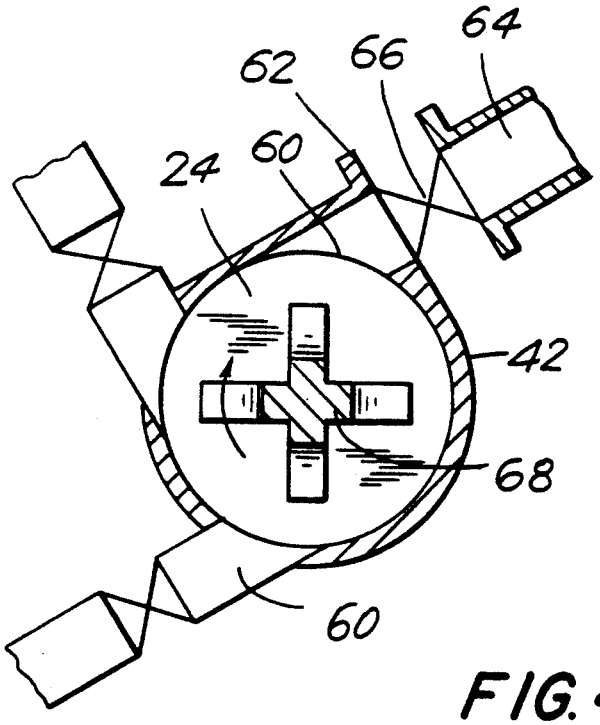
FIG. 4 is a cross-sectional view of still another embodiment of the apparatus in accordance with the present invention.

FIG. 4 illustrates yet another embodiment relating to the outlet openings. In FIG. 4 there are three outlet openings 60 with outlet channels 62 arranged substantially tangentially at the inside surface 42 of the vortex chamber 24 to which channel the outlet pipes 64 are connected by means of regulating valves 66. The outlet openings 60 are located in such a way that the rotor 68 causing the pulp to rotate in a strongly turbulent state throws the pulp towards the outlet openings 60 and while the regulating valves 66 are open the pulp flows out of the vortex chamber 24 in partial streams. Rotor 68 rotates in the direction of the arrow in FIG. 4. This type of arrangement with regard to the branch pipes 64 is preferred, as said branch pipes may be positioned at both sides of the apparatus and on the top of the apparatus so that the apparatus may, for example, be mounted to the floor of a pulp mill in a conventional manner.

Figure 5:
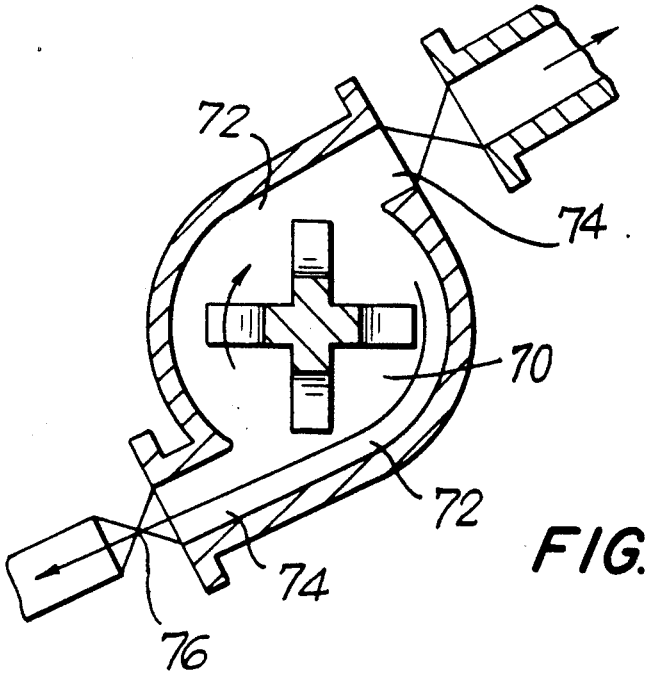
FIG. 5 is a cross-sectional view of a further embodiment of the apparatus in accordance with the present invention.

FIG. 5 illustrates a further embodiment of the apparatus in accordance with the present invention. In fact, this embodiment is a further modification of the embodiment illustrated in FIG. 4, wherein the vortex chamber is cylindrical. In accordance with FIG. 5 the vortex chamber 70 is formed of two spiral portions 72, the radius of which increases towards the respective outlet openings 74. It is understood that the dimensions of one spiral portion may differ from that of another spiral portion and the number of spiral portions as well as the outlet openings may exceed two. The outlet openings 74 may also be provided with valves 76 as shown or the valves may be omitted.

Figure 6:
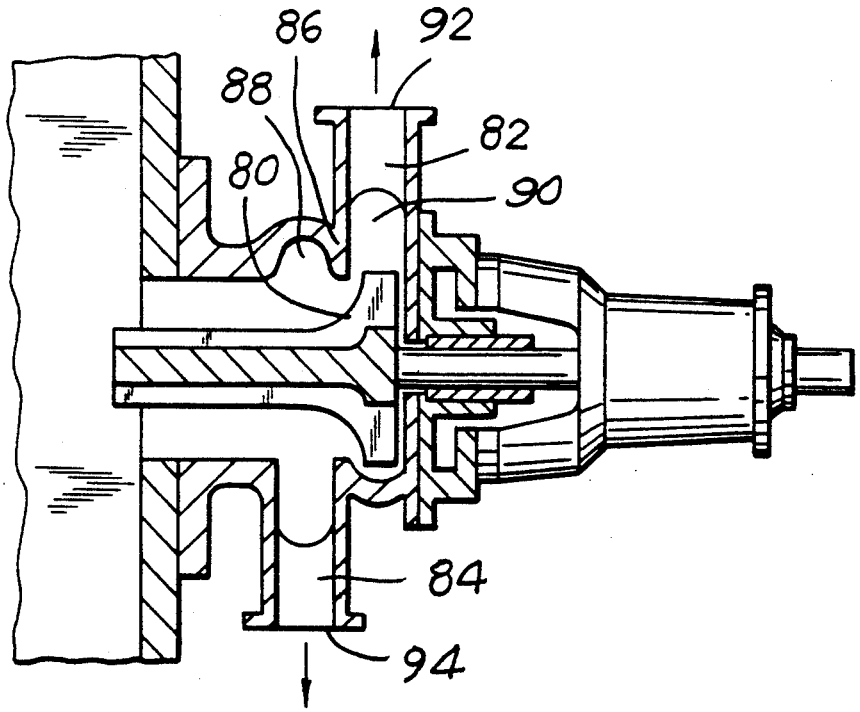
FIG. 6 is a longitudinal cross sectional view of an embodiment of the apparatus in accordance with the present invention.

FIG. 6 shows how to arrange several outlet openings 82, 84 in the vortex chamber 80. The housing 86 of chamber 80 may be provided with several axially spaced spirals 88, 90, of same or different size each including at least one outlet opening 92, 94 and optionally a valve (not shown) in connection with said opening. It is also possible to combine the embodiment of FIG. 6 with the embodiment shown in FIG. 2 or in FIG. 4 such that each spiral may be divided circumferentially in a number of spiral portions each having an outlet of its own. Also, the vortex chambers may be cylindrical and provided with one or more either radial or tangential outlet.

Figure 7:
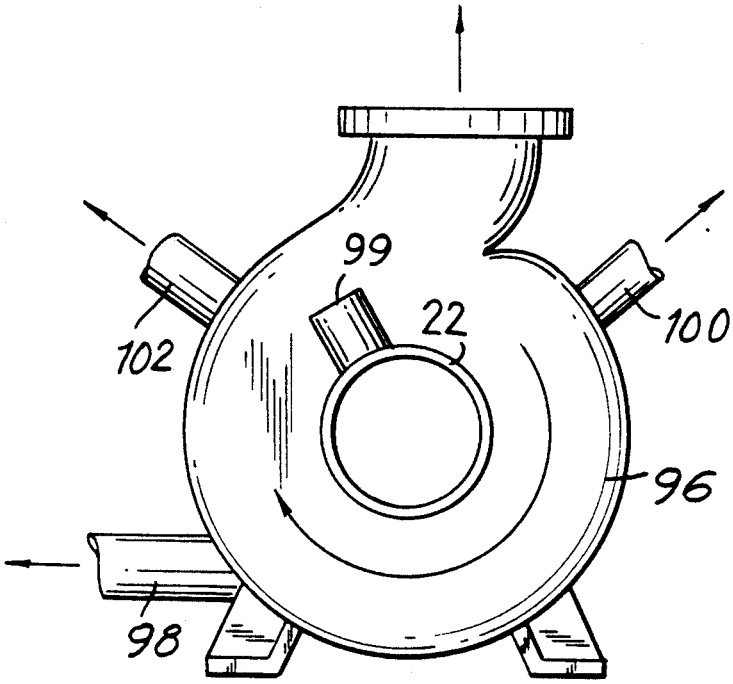
FIG. 7 is an end view of an embodiment of the apparatus in accordance with the present invention.

FIG. 7 shows how the vortex chamber or housing 96 may have one or more tangentially 98 and/or radially 100 outlet duct or that the duct or ducts may be directioned half tangential/half radially 102, whereby the direction of the outlets 98, 100, 102 may be chosen such that they extend always toward the free sides of the apparatus and not downwardly towards the floor. Also, the diameter of the outlets 100, 102 and/or 98 may differ as shown.

Figure 8:
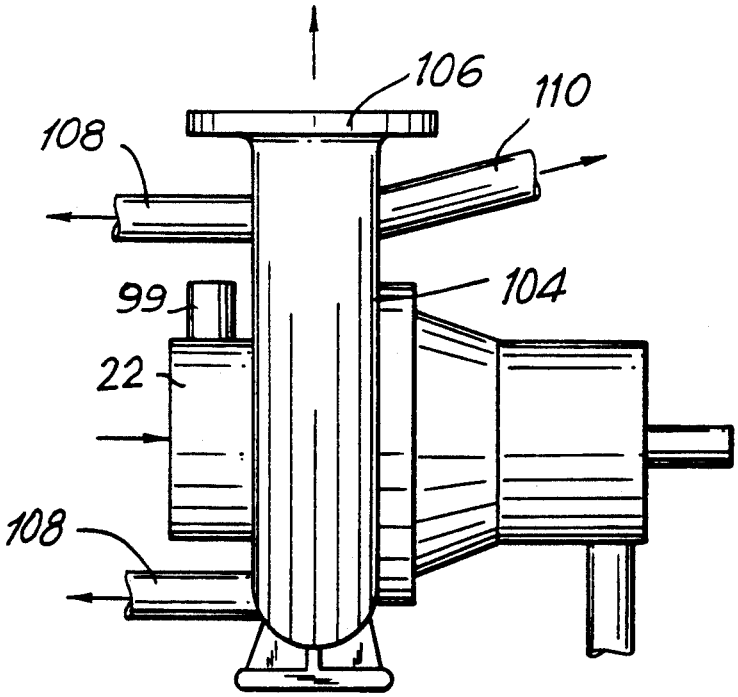
FIG. 8 is a side view of an embodiment of the apparatus in accordance with the present invention.

FIG. 8 shows how the outlet openings may extend from the vortex chamber or from the housing 104 not only in a radial plane 106 but also in axial direction 108 or in a direction 110 between radial and axial. FIGS. 7 and 8 show that the direction of the outlet openings 98, 100, 102, 106, 108, 110 may have any desired direction and that the outlet 99 may also be connected to the inlet channel 22 as opposed to the volute of the vortex chamber.

Figure 9:
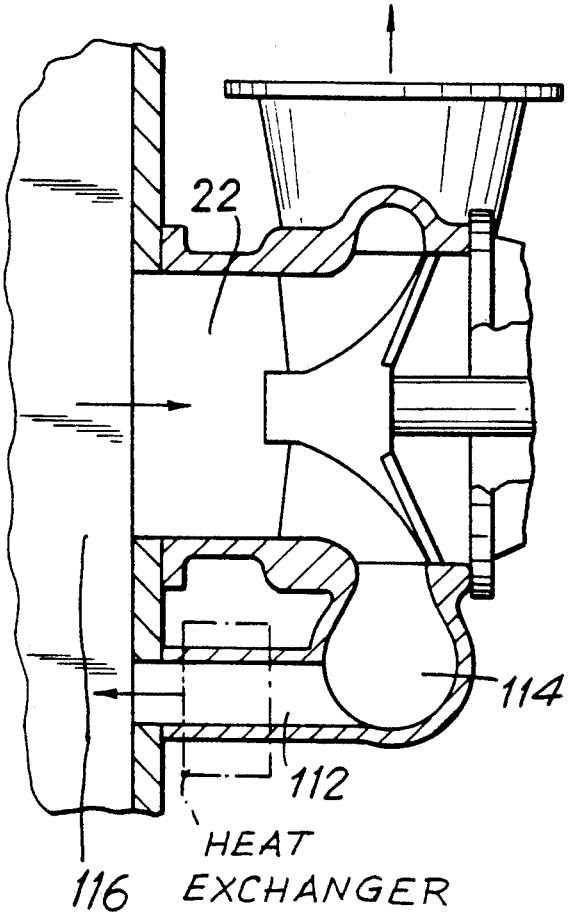
FIG. 9 is a longitudinal cross sectional view of an embodiment of the apparatus in accordance with the present invention.

FIG. 9 shows how one of the branch ducts 112 from the housing or from the spiral 114 may be directly connected to the suction vessel 116, drop leg or like device. A portion of the medium introduced into the apparatus is returned via said duct 112 back to the suction vessel 116, for instance, for keeping the bottom layer in said vessel moving, i.e. for preventing the solids of the medium from accumulating at the bottom of the vessel 116. Another possible application for a duct leading back to the suction vessel is where the pulp is to be heated by steam, whereby the branch pipe 112 from the vortex chamber could be lead through a steam heater (heat exchanger) back to the suction vessel.

Figure 10:
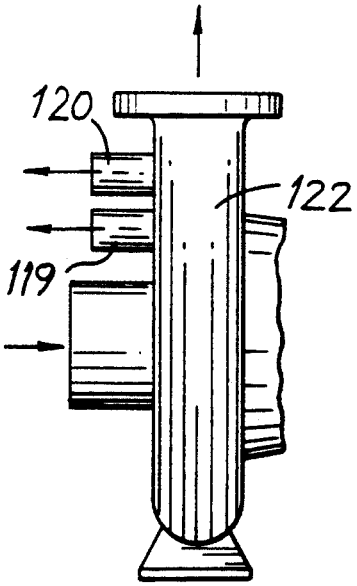
FIG. 10 shows yet another embodiment of the apparatus in accordance with the present invention.
Figure 11:
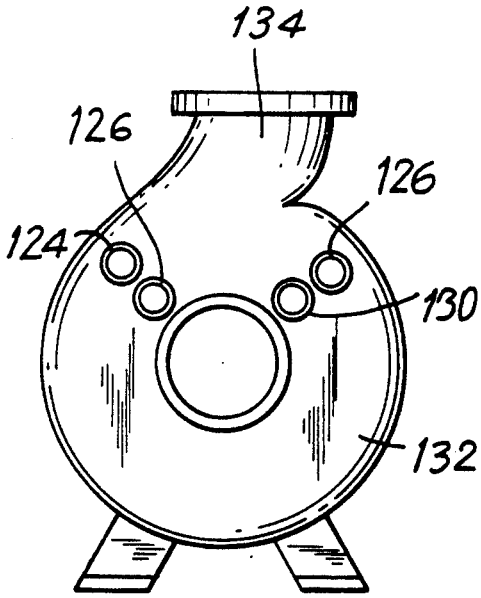
FIG. 11 shows still another embodiment of the apparatus of the present invention.

FIG. 10 shows two outlet ducts 119, 120 arranged in the vortex chamber or in the spiral 122 at different radial distances from the axis of the apparatus, leading to different pressures in the outlet ducts. FIG. 11 shows four outlet ducts 124, 126, 128, 130 arranged in the vortex chamber 132 at different locations along the outline of an imaginary spiral so that different pressures result also at different circumferential locations.

An important feature of the present invention is that the regulating means i.e. valves, in case they are used, are disposed at a short distance from the inner surface of the vortex chamber. The distance is suitably less than d and preferably less than d/2, when d represents the diameter of the respective outlet. The reason for this is the fact that a thick fiber suspension, for instance, a high consistency pulp, tends to form a rigid fiber plug inside the outlet openings i.e. inside the outlet channel leading from the outlet opening to the valve while the valve is closed or greatly throttled. If the outlet channel is too long the turbulence created by the rotor in the vortex chamber does not extend all the way to the valve thus allowing the fiber suspension filling the outlet channel to settle and to form a rigid fiber plug inside the channel. Equally, when the size of the plug inside the channel is allowed to increase, the pressure created by the vanes of the dividing apparatus is unable to push the plug through the valve when the valve is opened. To avoid these problems, the valves are preferably located in close vicinity to the vortex chamber.

Regulation of the flow may, in addition to the valves, be achieved in several other ways. The outlet openings may be of different size (FIG. 5) or they may be arranged in the vortex chamber such that the pressures acting in the openings are of different magnitude (FIGS. 10, 11).

The apparatus in accordance with the present invention results in a number of additional advantages.

One advantage of providing a great number of outlet openings in the vortex chamber is that the most suitable outlet can be chosen and the rest closed.

Another advantage is that any solid, liquid or gas can be fed through one or more of the openings or ducts into the vortex chamber. The medium to be fed may, for instance, be dilution liquid or chemicals. Accordingly, it is not necessary that all the openings or ducts in the vortex chamber, excluding the inlet opening for the pulp, are used as outlet openings for the pulp.

Still, one of the most important advantages relates to the reliable and cost efficient operation of the dividing apparatus. The flow regulating means may be arranged so close to the vortex chamber that the risk of clogging is practically negligible, also the power consumption of this type of dividing apparatus is significantly lower than that of an ordinary pump in combination with the dividing apparatus as disclosed in the parent patent application.

The embodiments illustrated in FIGS. 1 to 11 are only exemplary as the number, location and direction of the outlets may greatly differ from the ones shown. Also the direction of the shaft 40 of the dividing apparatus may be either vertical, horizontal or inclined depending on the location the apparatus is installed. The apparatus may be secured to any convenient part of the pulp vessel. It is also noted that the method and the apparatus in accordance with the invention are intended to cover embodiments wherein the number of regulating means, i.e. valves, is less than the number of outlets. The direction of the outlet channels may also vary greatly as they may be arranged, not only as illustrated either radially or tangentially, but also any direction therebetween.

It is thus understood that the preferred embodiments illustrated and described above are for illustrative purposes only and are not to be considered as limiting the scope of the invention which is properly delineated only in the appended claims.

What is claimed is:

1. An apparatus for dividing the flow of a pulp fiber suspension having a fiber content into partial streams having substantially the same fiber content comprising:

a first vortex chamber having an inside surface, an inlet channel for said pulp suspension connected to said vortex chamber including means for connecting said inlet channel to said fiber suspension source, and at least two outlets in said inside surface, said outlets being dimensioned and disposed so as to provide at least two outlet flows having substantially the same fiber content as the incoming pulp suspension and at least one of a different pressure and a different volume flow, said vortex chamber further comprising a shaft extending into said chamber, a solid rotor attached to said shaft and mounted for rotation within said chamber, said rotor extending substantially coaxially with said vortex chamber for rotating in said vortex chamber and for creating a field of turbulence in said suspension flowing through said vortex chamber of sufficient strength to divide said suspension into said partial streams and for creating a pressure difference between said inlet and said outlets for discharging said partial streams through said outlets.

2. The apparatus as recited in claim 1, wherein said rotor comprises vanes extending from said shaft towards said outlets for creating said turbulence in said vortex chamber and said pressure difference between said vortex chamber and said outlets.

3. The apparatus as recited in claim 1, wherein the respective diameters of said outlets are unequal.

4. The apparatus as recited in claim 1, wherein said outlet openings are arranged at different radial distances from said axis of said vortex chamber.

5. The apparatus as recited in claim 1, wherein the apparatus has a suction side and one of said outlets is connected to said suction side of said apparatus.

* * * * *